United States Patent [19]

Ikeda et al.

[11] Patent Number: 4,778,360

[45] Date of Patent: Oct. 18, 1988

[54] SUCTION AND/OR DISCHARGE VALVE PORT CONFIGURATION FOR REFRIGERANT COMPRESSOR

[75] Inventors: Hayato Ikeda; Toshihiro Kawai; Hideo Mori, all of Kariya, Japan

[73] Assignee: Kabushiki Kaisha Toyoda Jidoshokki Seisakusho, Aichi, Japan

[21] Appl. No.: 158,248

[22] Filed: Feb. 19, 1988

[30] Foreign Application Priority Data

Feb. 23, 1987 [JP] Japan ..... 62-25147[U]

[51] Int. Cl.[4] ..... F04B 39/10; F16K 15/16

[52] U.S. Cl. ..... 417/571; 137/856

[58] Field of Search ..... 417/559, 565, 569, 571; 137/855, 856

[56] References Cited

U.S. PATENT DOCUMENTS

| | | | |
|---|---|---|---|
| 2,784,671 | 3/1957 | Wilcox | 417/271 |
| 3,817,660 | 6/1974 | Knowles et al. | 417/269 |
| 4,257,457 | 3/1981 | Namura et al. | 137/856 X |

FOREIGN PATENT DOCUMENTS

| | | | |
|---|---|---|---|
| 2451207 | 5/1976 | Fed. Rep. of Germany | 417/559 |
| 639046 | 3/1928 | France | 417/565 |
| 50-150812 | 5/1974 | Japan | 417/571 |
| 18866 | 1/1982 | Japan | 137/856 |

*Primary Examiner*—Paul F. Neils

*Attorney, Agent, or Firm*—Burgess, Ryan and Wayne

[57] ABSTRACT

A refrigerant gas compressor having a compression chamber in a cylinder block, a suction and a discharge chamber in a cylinder head, a suction and a discharge port provided in a valve plate for fluid communication between the compression chamber and the suction and discharge chambers in response to the opening and closing of flapper type suction and discharge valves attached to the valve plate, the suction and/or discharge valve port having a non-circular opening configuration divergently spreading from one narrow end to the opposite wide end in reverse proportion to the amount of upward movement of the suction and/or discharge valve from the face of the valve plate.

3 Claims, 4 Drawing Sheets

SUCTION AND/OR DISCHARGE VALVE PORT CONFIGURATION FOR REFRIGERANT COMPRESSOR

BACKGROUND OF THE INVENTION

1. Field of the Invention

The present invention relates to an improvement in the performance of a suction and/or discharge mechanism of a refrigerant gas compressor which is provided with a valve plate located between a cylinder block having compression chambers for suction and compression of a refrigerant gas and a cylinder head having therein a suction and a discharge chamber for the refrigerant gas before and after compression, and more particularly, to a particular configuration of suction and/or discharge ports formed in the valve plate of the refrigerant gas compressor and cooperating with flapper-type suction and/or discharge valves so as to bring about a decrease in a suction and/or discharge resistance for the refrigerant gas flowing from the suction chamber to the compression chambers of the cylinder block via the suction ports, and/or from the compression chambers to the discharge chamber via the discharge ports.

2. Description of the Related Art

Many refrigerant gas compressors, such as a swash plate type compressor, a wobble plate type compressor, and a vertical crank-type compressor, are known. In general, the refrigerant gas compressor has a cylinder block having therein more than one compression chamber for compressing a refrigerant gas by the operation of compressing elements, such as reciprocating pistons, a cylinder head having therein a suction chamber for the refrigerant gas before compression and a discharge chamber for the refrigerant gas after compression, and a valve plate arranged between the cylinder block and the cylinder head as a partition therebetween. The valve plate has suction ports for communicating between the suction chamber of the cylinder head and respective compression chambers of the cylinder block, and discharge ports for communicating between respective compression chambers and the discharge chamber of the cylinder head. The suction ports of the valve plate are opened and closed by suction valves attached to the valve plate. Similarly, the discharge ports of the valve plate are opened and closed by discharge valves attached to the valve plate. Each of the suction and discharge valves is formed as a thin flapper type valve in the shape of an elongated plate having a front portion acting as a lid of the valve and moving toward and away from the associated suction or discharge port, and a base portion fixed to the valve plate by a screw bolt. The front portion of each discharge valve tightly closes the associated discharge port during the suction stroke of the related compressing element within the compression chamber, and opens the discharge port when it is moved away from the discharge port by the pressure of the compressed refrigerant gas during the discharge stroke of the related compressing element. The front portion of each suction valve opens the associated suction port, due to the suction pressure of the refrigerant gas during the suction stroke of the related compressing element, and tightly closes the associated suction port under the influence of the pressure of the compressed refrigerant gas during the discharge stroke of the related compressing element.

In the described conventional refrigerant gas compressor, each of the suction and discharge ports consists of a round port bored in the valve plate.

The movement of the above-mentioned front portion of each valve to open the associated port is carried out in such a manner that it is gradually and resiliently raised from the closed position toward a predetermined position whereat the valve adopts a slanted posture, and is stopped by a retainer plate. Therefore, while the round suction and/or discharge ports are opened by the associated flapper type suction and/or discharge valves in the slanted posture, the refrigerant gas which flows through a part of each of the round suction and/or discharge ports is inevitably subjected to a large flow resistance compared with the gas flowing through the other portion of each of the round suction and/or discharge ports. As a result, for example, in the case of the round discharge port of the valve plate of the conventional compressor, the performance of the refrigerant gas compressor is adversely affected by the various defects described below, with reference to FIGS. 7 through 9.

Referring to FIGS. 7 and 8, which are a partial cross-sectional and a plan view of the conventional discharge valve mechanism of a refrigerant gas compressor, respectively, a valve plate 3 is arranged between a compression chamber 1 and a discharge chamber 2 so as to act as a partition therebetween. The valve plate 3 has a discharge port 14 bored therein for communicating between the compression chamber 1 and the discharge chamber 2. A flapper type discharge valve 5 in the shape of an elongated resilient plate and a retainer plate 6 are arranged in the discharge chamber 2 and attached to the valve plate 3 by a screw bolt 7. A front portion **5*a* of the discharge valve 5 is disposed so as to close the discharge port 14, and can be raised by the pressure of the refrigerant gas discharged from the compression chamber 1 to a predetermined position whereat the valve 5 is stopped by the retainer 6, as shown in FIG. 7. That is, the retainer 6 determines the amount of upward movement of the front portion 5*a* of the valve 5**.

As previously described, the configuration of the discharge port 14 of the valve port 3 is a true circle. During the discharge stroke of the compressor, the compressed refrigerant gas flows from the compression chamber 1 toward the discharge chamber 2 through the discharge port 14. At this stage, from a macro viewpoint, the flow rate of the refrigerant gas passing through the circular discharge port 14 is approximately equivalent with respect to all positions of the port 14. However, as best illustrated in FIG. 7, the discharge valve 5 fixed, at a base portion thereof, to the valve plate 3 by the screw bolt 7 is allowed to bend only in the lengthwise direction about the fixing position under the pressure of the discharged gas so that the front portion **5*a* of the discharge valve 5 takes a slanted posture. Accordingly, when viewed in the lengthwise direction of the valve 5, the amount of upward movement of the front portion 5*a* of the discharge valve 5 from a top face 14' of the discharge port 14 cannot be equal in the diametrical direction of the port 14. As a result, the compressed refrigerant gas leaving the round or circular discharge port 14 and colliding with the slanted front portion 5*a* of the discharge valve 5 is subjected to an unequal resistance. Thus, the pressure of the refrigerant gas measured at diametrically various positions above the face 14' of the discharge port 14 becomes unequal, as illustrated in FIG. 9**.

It will be also understood from FIG. 9 that a large flow resistance to which the discharged refrigerant gas is subjected appears and is distributed in the various position of the port 14 far from the frontmost end of the front portion 5a of the discharge valve 5. Therefore, the following defects are encountered by the conventional refrigerant gas compressor.

(1) During the discharge stroke of the compressor, a part of the compressed refrigerant gas is not discharged, and remains within the compression chamber 1. The remaining gas is then expanded during the subsequent suction stroke of the compressor and thus prevents a sufficient amount of the refrigerant gas from being pumped into the compression chamber 1 from a suction chamber (not shown in FIG. 1). Thus, the suction performance of the compressor is degraded.

(2) During the compression stroke of the compressor, a part of the refrigerant gas which was not discharged from the compression chamber 1 during the preceding discharge stroke, is re-compressed. Thus, excessive compression occurs in the compression chamber 1. Such excessive compression generates a reaction force acting on the compression drive mechanism, such as a piston mechanism. Therefore, the compression drive mechanism always requires more power to compress the refrigerant gas, and thus a loss of power occurs in the operation of the conventional compressor.

(3) Unstable opening and closing motions of the discharge valve 5 occur and, therefore, a pulsation appears in the flow of the discharged refrigerant gas. This pulsation in the flow of the discharged refrigerant gas generates noise.

Similarly, in the case of the suction valve mechanism having round suction ports of the valve plate, a like degradation in the suction performance and a suction pulsation problem are encountered.

SUMMARY OF THE INVENTION

An object of the present invention is to obviate the defects encountered by the conventional refrigerant gas compressor with the round suction and/or discharge ports.

Another object of the present invention is to provide a refrigerant gas compressor having suction and/or discharge ports of the valve plate, in which the refrigerant gas flowing through the suction and/or discharge ports is subjected to an equal discharge and/or suction resistance.

A further object of the present invention is to provide a refrigerant gas compressor, having suction and/or discharge ports of the valve plate, which does not suffer from the degradation of the suction performance of the compressor.

A still further object of the present invention is to provide a refrigerant gas compressor, having suction and/or discharge ports of the valve plate, which does not suffer from the problem of pulsations in the suction and/or discharge flow of the refrigerant gas.

A further object of the present invention is to ensure the least power loss during the operation of a refrigerant gas compressor.

In accordance with the present invention, there is provided a refrigerant gas compressor which comprises:

a cylinder block defining therein a compression chamber for compressing a refrigerant gas by a compressing means;a cylinder head disposed on the cylinder block for defining therein a suction chamber for the refrigerant gas before compression and a discharge chamber for the refrigerant gas after compression; a valve plate arranged between the cylinder block and the cylinder head for providing a suction port to communicate between the suction chamber of the cylinder head and the compression chamber of the cylinder block, and a discharge port to communicate between the compression chamber and the discharge chamber of the cylinder head; an axially extended flexible suction valve arranged in the compression chamber so as to open and close the suction port of the valve plate, the suction valve having a base portion fixed to the valve plate, and a front bendable portion taking a flat closure position in contact with the valve plate to close the suction port during compression and discharge strokes of the compressing means and a bent open position raised from the closure position during a suction stroke of the compressing means in such a manner that the amount of upward movement of the front bendable portion axially gradually decreases from the frontmost end toward a rear position adjacent to the base portion; an axially extended flexible discharge valve arranged in the discharge chamber so as to open and close the discharge port of the valve plate, the discharge valve having a base portion fixed to the valve plate, and a front bendable portion taking a flat closure position in contact with the valve plate to close the discharge port during suction stroke of the compressing means and a bent open position raised from the closure position during discharge stroke of the compressing means in such a manner that the amount of upward movement of the front bendable portion axially gradually decreases from the frontmost end thereof toward a rear position adjacent to the base portion; and at least one of the suction and discharge ports of the valve plate having a configuration of a non-circular opening divergently spreading from one narrow end toward the opposite wide end in reverse proportion to the amount of upward movement of the associated one of the suction and discharge valves.

BRIEF DESCRIPTION OF THE DRAWINGS

The above and other objects, features and advantages of the present invention will be made apparent from the ensuing description of the embodiments of the present invention with reference to the accompanying drawings, wherein.

DESCRIPTION OF THE PREFERRED EMBODIMENTS

Figure 1:
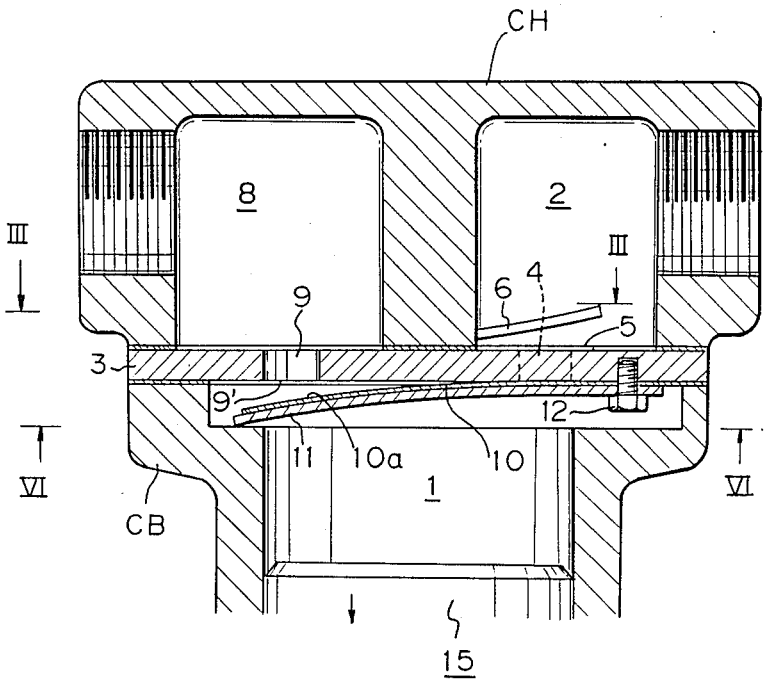
FIG. 1 is a fragmentary cross-sectional view of a suction and a discharge valve mechanism of a refrigerant gas compressor, embodying the present invention.

Referring to FIG. 1, a refrigerant compressor includes a cylinder block CB having at least one compression chamber 1 (a cylinder bore for receiving a piston 15 to compress a refrigerant gas, in the case of the present embodiment), a cylinder head CH having therein a suction chamber 8 for a refrigerant gas before compression and a discharge chamber 2 for a refrigerant gas after compression, and a valve plate 3 arranged between the cylinder block CB and the cylinder head CH. The valve plate 3 has a suction port 9 formed therein for communicating between the suction chamber 8 and the compression chamber 1, and a discharge port 4 formed therein for communicating between the compression chamber 1 and the discharge chamber 2. The suction port 9 is opened and closed by a flapper type flexible suction valve 10 having a front portion confronting the suction port 9 and a base portion fixed to the valve plate 3 by a screw bolt 12. A plate-like retainer 11 determining the amount of upward movement of the suction valve 10 from an inner face 9' of the suction port 9 is also fixed to the valve plate 3 by the screw bolt 12. The discharge port 4 is opened and closed by a flapper type discharge valve 5 having a front bendable portion confronting the discharge port 4 and a base portion fixed to the valve plate 3 by a screw bolt (not appearing in FIG. 1) which also fixes a retainer 6 to the valve plate 3. FIG. 1 illustrates the suction stroke of the compressor (or the piston 5).

Figure 2:
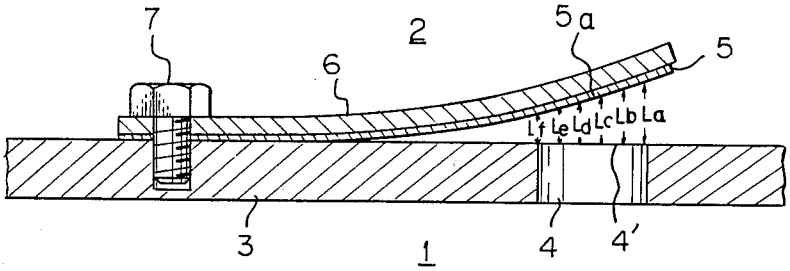
FIG. 2 is a partial cross-sectional view, taken along the line II—II of FIG. 3, of the discharge valve mechanism having a discharge port according to the present invention.
Figure 3:
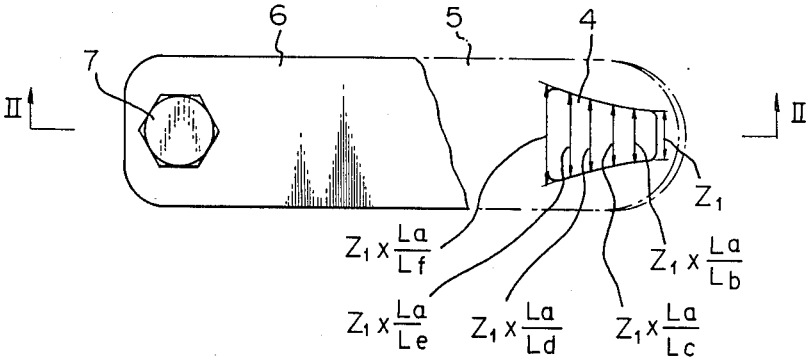
FIG. 3 is a plan view, partly cut away, taken along the line III—III of FIG. 1, illustrating the configuration of the discharge port.

Referring now to FIGS. 2 and 3, illustrating the discharge valve mechanism according to the present invention, the long flexible discharge valve 5 arranged in the discharge chamber 2, and having a front portion 5*a* operating as a lid to open and close the discharge port 4 is fixed to the valve plate 3 by a screw bolt 7 at a base portion thereof. The retainer 6 is also fixed to the valve plate 3 by the same screw bolt 7. In the suction stroke of the compressor, the flexible discharge valve 5 is in tight contact with the outer face 4' of the discharge port 4 to close the discharge port 4. In the discharge stroke of the compressor, the front bendable portion 5*a* of the discharge valve 5 is raised from the face 4' of the discharge port 4 to a position at which it is stopped by the retainer 6 under the pressure of the refrigerant gas discharged from the compression chamber 1 thereby opening the discharge port 4.

As best shown in FIG. 3, the discharge port 4 of the valve plate 3 has a non-circular opening configuration. That is, when viewing the port 4 from above, the discharge port 4 has a configuration continuously divergently spreading from one narrow end adjacent to the frontmost end of the valve front portion 5*a* toward the opposite wide end far from the same frontmost end of the valve front portion 5*a* along the longitudinal axis of the discharge valve 5. The lateral width Z of the discharge port 4 is $Z_1$ at the narrow end, and is determined so that it is gradually increased in reverse proportion to the amount of upward movement L of the front portion 5*a* of the discharge valve 5. As illustrated in FIG. 2, the amount of upward movement L of the front portion 5*a* of the discharge valve 5 continuously changes from the maximum La to the minimum Lf along the longitudinal axis of the valve 5 per se, via Lb, Lc, Ld, and Le. Thus, the lateral width Z of the discharge port 4 is, for example, $Z_1 \times La/Lb$, at the position where the amount of upward movement of the discharge valve 5 is Lb, and $Z_1 \times La/Lf$ at the position where the amount of upward movement L of the discharge valve 5 is the smallest Lf.

Figure 6:
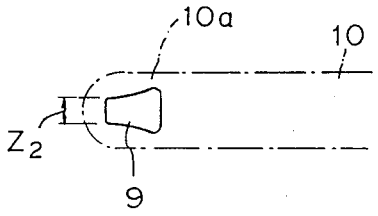
FIG. 6 is a plan view of a suction port of a refrigerant gas compressor embodying the present invention, taken along the line VI—VI of FIG. 1.

Referring to FIG. 6 in addition to FIG. 1, a suction port 9 of the suction valve mechanism of FIG. 1, embodying the present invention is shown.

During the compression and discharge strokes of the compressor, the suction port 9 is closed by the front portion 10*a* of the suction valve 10 which comes into a tight contact with the inner face 9' of the suction port 9 under the pressure of the refrigerant gas within the compression chamber 1. When the suction stroke of the compressor (the piston 15) is started after the discharge stroke, the front portion 10*a* of the suction valve 10 is raised from the face 9' of the suction port 9 toward inside the compression chamber 1 until it is stopped by the retainer 11.

The suction port 9 has a non-circular opening configuration similar to that of the above-described discharge port 4 of FIGS. 2 and 3. That is, the suction port 9 has a configuration continuously divergently spreading from one narrow end adjacent to the frontmost end of the front portion 10*a* of the suction valve 10 toward the opposite wide end far from the same frontmost end of the suction valve 9 along the longitudinal axis of the suction valve 10. The lateral width Z of the suction port 9 is $Z_2$ at the narrow end, and is determined so that it is gradually increased in reverse proportion to the amount of upward movement of the front portion 10*a* of the suction valve 9.

Figure 4:
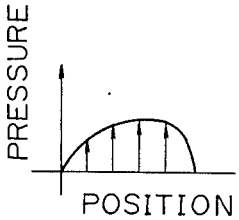
FIG. 4 is a graphical view of the pressure of the refrigerant gas discharged from the discharge port of FIG. 3, measured at various positions above the discharge port.

The operation of the discharge port 4 of the discharge valve mechanism according to the embodiment of the present invention will be described hereinbelow with reference to FIGS. 4 and 5 in addition to FIGS. 1 through 3. It should be appreciated that a similar operation will be implemented by the suction port 9 of the suction valve mechanism of the refrigerant gas compressor.

Referring to FIGS. 2 and 3, the flexible discharge valve 5 is bent toward and raised to a full open position bearing against the retainer 6 under the pressure of the compressed refrigerant gas discharged from the compression chamber 1. Various positions of the front portion 5*a* of the discharge valve 5 have different amounts of upward movement La, Lb, Lc, Ld, Le and Lf from the flat position of the valve 5 in contact with the face 4' of the discharge port 4 of the valve plate 3.

The discharge port 4 having the configuration of a non-circular opening is determined and formed in such a manner that the lateral widths at various positions thereof corresponding to the above-mentioned various positions of the discharge valve 5 are in reverse proportion to the corresponding amounts of upward movement of the front portion 5*a* of the discharge valve 5. That is, the lateral widths are $Z_1$ at the narrowest end, $Z_1 \times La/Lb$, $Z_1 \times La/Lc$, $Z_1 \times La/Ld$, $Z_1 \times La/Le$, and $Z_1 \times La/Lf$ at the widest end, respectively. Therefore, it will be understood that the product of the lateral width at a position of the non-circular discharge port 5 and the amount of upward movement of the corresponding position of the front portion 5*a* of the discharge valve 5 is approximately constant. Accordingly, when the refrigerant gas after compression is discharged from the compression chamber 1 toward the discharge chamber 2 through the discharge port 4, the flow rate of the refrigerant gas can be approximately equal at all positions of the discharge port 5. That is, the refrigerant gas passing through the non-circular discharge port 4 is subjected to an equal resistance at all positions of the port 4. Consequently, as illustrated in the graph of FIG. 4, the pressure of the refrigerant gas measured at various positions above the discharge port 4 exhibits an approximately even pressure curve. Thus, a local increase in the discharge pressure of the refrigerant gas after compression can be prevented.

It will be understood that, according to the particular non-circular configuration of the suction and/or discharge port of the valve plate of the refrigerant gas compressor, since the suction and/or discharge pressure of the refrigerant gas passing through the suction and/or discharge port can be approximately equal at all positions of the suction and/or discharge port, the problems of a reduction in the suction performance, loss of power, and pulsations in the flow of refrigerant gas can be solved.

Figure 5:
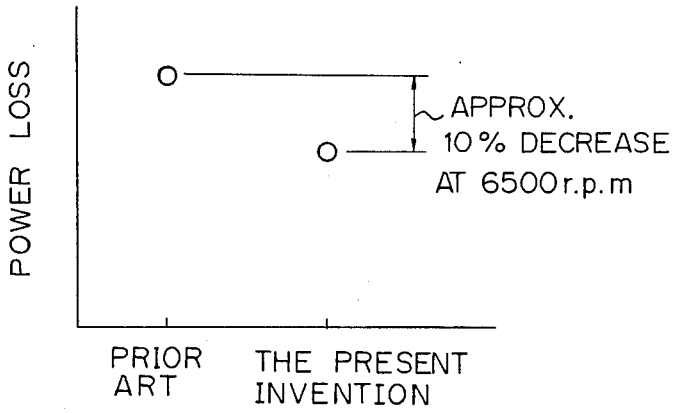
FIG. 5 is a graphical view indicating a comparison between power loss of the compressor embodying the present invention and that of the compressor of the prior art.
Figure 7:
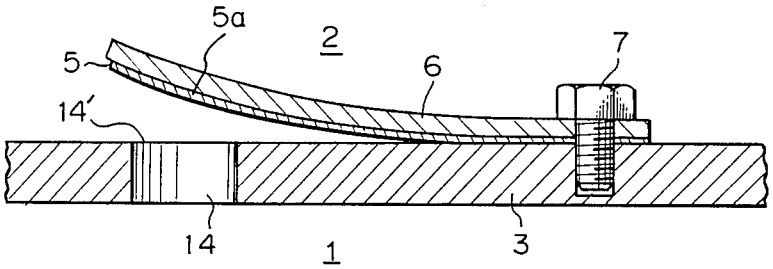
Fig. 7 (PRIOR ART)
FIG. 7 is a cross-sectional view of a discharge valve mechanism of a refrigerant gas compressor, according to the prior art.
Figure 8:
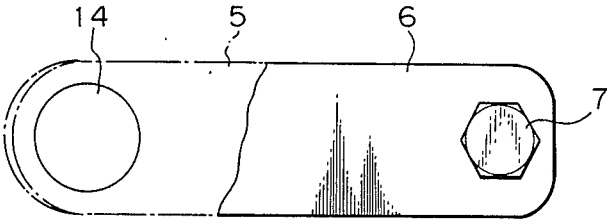
Fig. 8 (PRIOR ART)
FIG. 8 is a plan view of a conventional discharge port of the mechanism of FIG. 7.
Figure 9:
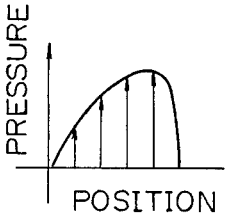
Fig. 9 (PRIOR ART)
FIG. 9 is a graphical view of the pressure of the refrigerant gas discharged from the conventional discharge port of FIG. 8, measured at various positions above the discharge port.

FIG. 5 indicates that the power loss encountered by a refrigerant gas compressor according to the present invention can be approximately 10% smaller than that encountered by the refrigerant gas compressor of the prior art.

It should be understood that various modifications and variations will further occur to a person skilled in the art without departing from the scope of appended claims.

We claim:

1. A refrigerant gas compressor comprising:

a cylinder block defining therein a compression chamber for compressing a refrigerant gas by a compressing means;

a cylinder head disposed on said cylinder block for defining therein a suction chamber for the refrigerant gas before compression, and a discharge chamber for the refrigerant gas after compression;

a valve plate arranged between said cylinder block and said cylinder head for providing a suction port to communicate between said suction chamber of said cylinder head and said compression chamber of said cylinder block, and a discharge port to communicate between said compression chamber and said discharge chamber of said cylinder head;

an axially extended flexible suction valve arranged in said compression chamber so as to open and close said suction port of said valve plate, said suction valve having a base portion fixed to said valve plate, and a front bendable portion taking a flat closure position in contact with said valve plate to close said suction port during compression and discharge strokes of said compressing means and a bent open position raised from said closure position during a suction stroke of said compressing means in such a manner that the amount of upward movement of said front bendable portion axially gradually decreases from the frontmost end toward a rear position adjacent to said base portion;

an axially extended flexible discharge valve arranged in said discharge chamber so as to open and close said discharge port of said valve plate, said discharge valve having a base portion fixed to said valve plate and a front bendable portion taking a flat closure position in contact with said valve plate to close said discharge port during a suction stroke of said compressing means and a bent open position raised from said first position during a discharge stroke of said compressing means in such a manner that the amount of upward movement of said front bendable portion axially gradually decreases from the frontmost end thereof toward a rear position adjacent to said base portion; and at least one of said suction and discharge ports of said valve plate having a non-circular opening configuration divergently spreading from one narrow end toward an opposite wide end in reverse proportion to said amount of upward movement of the associated one of said suction and discharge valves.

2. A refrigerant gas compressor according to claim 1, wherein both of said suction and discharge ports have said configuration of a non-circular opening.

3. A refrigerant gas compressor according to claim 1, wherein said compressing means comprises a reciprocatory piston provided in said compression chamber.

* * * * *